US010495259B2

(12) United States Patent
Tom et al.

(10) Patent No.: US 10,495,259 B2
(45) Date of Patent: Dec. 3, 2019

(54) FLUID DELIVERY SYSTEM AND METHOD

(71) Applicant: Entegris, Inc., Billerica, MA (US)

(72) Inventors: Glenn M. Tom, Billerica, MA (US); Donald D. Ware, Billerica, MA (US); Richard D. Chism, Billerica, MA (US); Jordan Hodges, Billerica, MA (US); Mitchell W. McFeron, Billerica, MA (US)

(73) Assignee: ENTEGRIS, INC., Billerica, MA (US)

( * ) Notice: Subject to any disclaimer, the term of this patent is extended or adjusted under 35 U.S.C. 154(b) by 103 days.

(21) Appl. No.: 15/634,686

(22) Filed: Jun. 27, 2017

(65) Prior Publication Data

US 2017/0292653 A1 Oct. 12, 2017

Related U.S. Application Data

(62) Division of application No. 14/380,646, filed as application No. PCT/US2013/027301 on Feb. 22, 2013, now Pat. No. 9,695,985.

(60) Provisional application No. 61/602,898, filed on Feb. 24, 2012.

(51) Int. Cl.

| | |
|---|---|
| ***F17C 9/00*** | (2006.01) |
| ***B67D 7/02*** | (2010.01) |
| ***B67D 7/00*** | (2010.01) |
| ***F17C 7/00*** | (2006.01) |

(52) U.S. Cl.

CPC ..... *F17C 9/00* (2013.01); *B67D 7/00* (2013.01); *B67D 7/02* (2013.01); *B67D 7/025* (2013.01); *B67D 7/0272* (2013.01); *B67D 7/0283* (2013.01); *F17C 7/00* (2013.01)

(58) Field of Classification Search

CPC ..... F17C 9/00; F17C 7/00; B67D 7/00; B67D 7/02; B67D 7/025; B67D 7/0272; B67D 7/0283

See application file for complete search history.

(56) References Cited

U.S. PATENT DOCUMENTS

| | | | | |
|---|---|---|---|---|
| 4,524,801 A * | 6/1985 | Magnasco | ..... | B01F 15/0454 137/565.33 |
| 5,148,945 A * | 9/1992 | Geatz | ..... | B01F 15/00422 137/205 |
| 5,330,072 A * | 7/1994 | Ferri, Jr. | ..... | B01F 15/00422 137/205 |
| 5,417,346 A * | 5/1995 | Ferri, Jr. | ..... | B01F 15/00422 137/205 |

(Continued)

FOREIGN PATENT DOCUMENTS

| | | |
|---|---|---|
| CN | 101672424 A | 3/2010 |
| CN | 102084114 A | 6/2011 |

(Continued)

*Primary Examiner* — Matthew W Jellett
(74) *Attorney, Agent, or Firm* — Entegris, Inc.

(57) ABSTRACT

A fluid supply system adapted for vacuum and pressure cycling of fluid, including a transfer vessel adapted to supply a process canister with fluid drawn from a bulk canister under a vacuum, wherein delivery of fluid from the transfer vessel to the process canister is accomplished with positive pressure. A method is also disclosed of delivering fluid, including drawing fluid under vacuum from a bulk canister and pressurizing the transfer vessel to effect dispensing of the fluid into a process canister for delivery to a location of use.

11 Claims, 5 Drawing Sheets

(56) References Cited

U.S. PATENT DOCUMENTS

| | | | |
|---|---|---|---|
| 5,562,132 | A | 10/1996 | Siegele et al. |
| 5,935,305 | A | 8/1999 | Tom et al. |
| 6,019,116 | A | 2/2000 | Schell |
| 6,047,744 | A | 4/2000 | Jackson |
| 6,192,919 | B1 | 2/2001 | Jackson et al. |
| 6,607,097 | B2 | 8/2003 | Savage et al. |
| 6,851,579 | B2 | 2/2005 | Savage et al. |
| 6,984,278 | B2 | 1/2006 | Anderson et al. |
| 7,022,058 | B2 | 4/2006 | Lee |
| 7,172,096 | B2 | 2/2007 | O'Dougherty |
| 7,335,721 | B2 | 2/2008 | Alberg |
| 8,313,821 | B2 | 11/2012 | Yan et al. |
| 9,079,758 | B2 | 7/2015 | O'Dougherty et al. |
| 9,695,985 | B2 | 7/2017 | Hodges et al. |
| 2002/0038676 | A1 | 4/2002 | Siegele et al. |
| 2003/0010792 | A1 | 1/2003 | Forshey et al. |
| 2003/0185690 | A1 | 10/2003 | Xu et al. |
| 2003/0205581 | A1 | 11/2003 | Wertenberger |
| 2007/0007879 | A1 | 1/2007 | Bergman, Jr. et al. |
| 2009/0212071 | A1 | 8/2009 | Tom et al. |
| 2010/0059528 | A1 | 3/2010 | Zhevago et al. |
| 2010/0112815 | A1 | 5/2010 | O'Dougherty et al. |
| 2011/0187028 | A1 | 8/2011 | Menning et al. |

FOREIGN PATENT DOCUMENTS

| | | | |
|---|---|---|---|
| JP | H04-102600 | A | 4/1992 |
| JP | H05-294396 | A | 11/1993 |
| JP | H08-337296 | A | 12/1996 |
| JP | 2000-352375 | A | 12/2000 |
| JP | 2002-145280 | A | 5/2002 |
| JP | 2002-533275 | A | 10/2002 |
| JP | 2005-524584 | A | 8/2005 |
| JP | 2008-521087 | A | 6/2008 |
| JP | 2009-138849 | A | 6/2009 |
| WO | 92/05406 | A1 | 4/1992 |
| WO | 94/21551 | A1 | 9/1994 |
| WO | 00/39021 | A1 | 7/2000 |
| WO | 2007/146892 | A2 | 12/2007 |
| WO | 2008/095024 | A1 | 4/2008 |
| WO | 2009/076101 | A1 | 6/2009 |
| WO | 2011/006146 | A2 | 1/2011 |
| WO | 2011/046802 | A2 | 4/2011 |
| WO | 2012/051093 | A2 | 4/2012 |
| WO | 2012/071370 | A2 | 5/2012 |
| WO | 2012/071376 | A2 | 5/2012 |
| WO | 2012/078977 | A2 | 6/2012 |
| WO | 2012/118527 | A1 | 9/2012 |
| WO | 2013/028746 | A2 | 2/2013 |
| WO | 2013/096579 | A1 | 6/2013 |

* cited by examiner

FLUID DELIVERY SYSTEM AND METHOD

CROSS-REFERENCE TO RELATED APPLICATIONS

This application is a Divisional of U.S. patent application Ser. No. 14/380,646, filed Aug. 22, 2014, which is a National Phase entry of PCT Application No. PCT/US2013/027301, filed Feb. 22, 2013, which claims priority to U.S. Provisional Application No. 61/602,898, filed Feb. 24, 2012, the disclosures of which are incorporated by reference in their entirety.

FIELD

The present disclosure relates to fluid delivery systems and methods. Aspects of the disclosure, hereinafter described, relate to systems and methods that minimize entrained gases in fluids, accommodate fluid transfer from a wide variety of fluid containers, and minimize cost and waste associated with known fluid delivery systems. While the focus of the present disclosure is primarily on fluid delivery systems and methods for semiconductor applications, the systems and methods disclosed herein are adaptable in a broad array of fields.

BACKGROUND

Fluid storage and dispensing vessels are used in a wide variety of industrial, commercial, and personal applications, including, but not limited to, semiconductor fabrication, biomedical and pharmaceutical processes, and many other fields requiring supply of high purity fluids. Various types of liquids, gases, and solid-liquid slurries may be supplied from these vessels, e.g., pressure-rated stainless steel storage cylinders.

Pressure-rated stainless steel containers have many known disadvantages, such as in applications involving storage and dispensing of certain high-purity fluids utilized in the semiconductor industry. Stainless steel is reactive with various fluids. Stainless steel vessels are also not readily disposable. Further, stainless steel vessels are not generally recyclable without return of used vessels to the original equipment manufacturer (OEM) or supplier.

FIG. 2A is a flow chart that shows a conventional supply loop sequence of canisters that are employed in the semiconductor industry. The sequence of processing steps may include filling of a canister with fluid, packaging of the canister, shipment of the canister to a customer, use of the canister by the customer, shipment of the canister to the supplier (denoted ATMI, for example), arrival of the canister in the factory of the supplier, removal of residual chemistry from the vessel, cleaning of the canister, rebuilding and installation of the valve assembly, and refilling and packaging of the canister.

Such cycle involving return of fluid-depleted vessels to the supplier results in expensive refurbishment, cleaning, and component replacement, as is reflected by the chart of FIG. 2B, in which the costs associated with the process loop of FIG. 2A are broken down by cost components, including, in sequence from top to bottom of the three-dimensional column shown in FIG. 2B, shipping cost from the customer, shipping cost to the customer, packaging cost, cost to fill, cost to rebuild valves, cost to clean, cost to remove residual chemistry, and amortized canister cost. The estimated cost of one pressure-rated stainless steel canister making a full cycle in the supply loop shown in FIG. 2A is approximately $700, wherein the estimated cost components of the loop without the canister is approximately $325.

Despite these various costs, and the disadvantages of using stainless steel for fluid supply operations in the semiconductor industry, pressure-rated stainless steel vessels are typically selected for service in semiconductor manufacturing operations, however, due to their pressure ratings and cleanliness specifications.

A substantial number of fluid delivery systems in semiconductor manufacturing applications use a pressure differential to transfer fluids through a dip tube in a bulk canister to a process canister, with the process canister generally being maintained at a constant pressure for uninterrupted supply of fluid. One problem with this design is the requirement that the pressure in the bulk canister must be elevated above the pressure in the process canister in order to effect delivery of liquid into the process canister. As such, these systems generally require the bulk canister to be a pressure-rated stainless steel vessel that is costly to produce (e.g., involving a manufacturing cost on the order of $2,000-$5,000), as well as costly to service and transport, in addition to the stainless steel material construction being reactive with various fluids commonly used in semiconductor manufacturing operations.

A standard pressure level such as 30 psi (206.84 kPa) within the process canister is commonly employed for delivery of fluid in semiconductor manufacturing operations, but the pressure in specific applications may be higher depending on distance between the supply vessel and the semiconductor processing tool, and fluid pressure requirements at the semiconductor processing tool. A bulk canister typically must be at least 5 psi (34.5 kPa) higher than the process canister to ensure efficient transfer of the fluid into the pressurized process canister. Such pressures are increased for fab-wide distribution systems supplying chemicals from a single central bulk delivery system.

High pressure gas in the bulk canister (and other canisters of the process system) will over time, however, result in gas being dissolved in the dispensed fluid (i.e., gas entrainment will occur). Such occurrence in turn necessitates the provision of a degasser downstream from the fluid delivery system to remove the entrained gas. Degassers, however, are not always 100% effective. Moreover, as a majority of fluid is dispensed from the canister, the remaining fluid tends to contain a greater concentration of entrained gas, with the result that the residual fluid usually is discarded. Such discarded volume may be as much as 10% or more of the original fluid charge in the vessel. Given that most semiconductor fluids are very expensive, any waste of fluid is problematic.

FIG. 3 shows a conventional fluid delivery system 300 including a bulk canister 301 and a process canister 302 that are interconnected in fluid flow relationship with one another, with each having associated pressurizing and dispensing lines, arranged so that the fluid flows through the connecting line, from the bulk canister 301 to the process canister 302 in the direction indicated by arrow 305. In this conventional system, the bulk canister 301 is pressurized to a pressure level that is greater than that of the process canister 302. The process canister 302 is arranged to supply fluid to a location of use (e.g., a semiconductor manufacturing tool, not shown in FIG. 3)). Each of the inlet flow circuits to the respective bulk and process canisters includes a pressurizing gas line and a vacuum line. The pressurizing gas line may be coupled to a source of pressurizing gas, such as an inert gas, e.g., helium, argon, nitrogen, etc.

In canisters of the type illustratively shown in FIG. 3, measurement of fluid remaining in the canisters is often accommodated by the provision of float sensors in such vessels. Float sensors, however, are costly and have a history of failure.

In consequence, the art continues to seek improvements in fluid delivery systems and methods. Specific objective include simplification of the fluid delivery system, reduction of cost of bulk containers, and elimination or reduction of fluid losses due to gas entrainment.

SUMMARY

The present disclosure relates to fluid delivery systems and methods.

In one aspect, the disclosure relates to a fluid supply system adapted for vacuum and pressure cycling of fluid, the system comprising:

a process canister adapted for delivery of fluid to a location of use; and a transfer vessel adapted to supply the process canister with fluid from at least one bulk canister, wherein the transfer vessel is coupled with (i) a vacuum source arranged for drawing fluid from at least one bulk canister into the transfer vessel and selectively maintaining a vacuum condition in the at least one bulk canister, and (ii) a first source of pressurizing gas arranged for pressure-mediated transfer of fluid from the transfer vessel into said process canister.

In another aspect, the disclosure relates to a method of delivering fluid for use thereof, the method comprising: drawing fluid under vacuum from at least one bulk canister into a transfer vessel; pressurizing the transfer vessel to force dispensing of the fluid to a process canister, and supplying gas to the process canister to effect delivery of fluid to a location of use, wherein gas supplied to the process canister is at a lower pressure than gas supplied to the transfer vessel.

In another aspect, the disclosure relates to a fluid supply system adapted for pressure dispense of the fluid, the system comprising: a reservoir adapted to supply a downstream process with fluid from at least one tote, wherein the reservoir is coupled with (i) a first source of pressurizing gas arranged for pressure-mediated transfer of fluid from the at least one tote into the reservoir at a pressure of less than 3 psig, and (ii) a second source of pressurizing gas arranged for pressure-mediated transfer of fluid from the reservoir to the downstream process.

In yet another aspect, the disclosure relates to a method of delivering fluid for use thereof, the method comprising delivering fluid from at least one tote into a reservoir by applying gas from a first pressure source at a first pressure to the tote; delivering fluid from the reservoir to a downstream process by applying gas from a second pressure source at a second pressure to the reservoir, wherein gas applied to the tote is at a lower pressure than gas applied to the reservoir.

A method of delivering fluid for use thereof, the method comprising delivering fluid from at least one tote into a reservoir; and delivering fluid from the reservoir to a downstream process.

Other aspects, features and embodiments of the disclosure will be more fully apparent from the ensuing description and appended claims.

DETAILED DESCRIPTION

Figure 1:
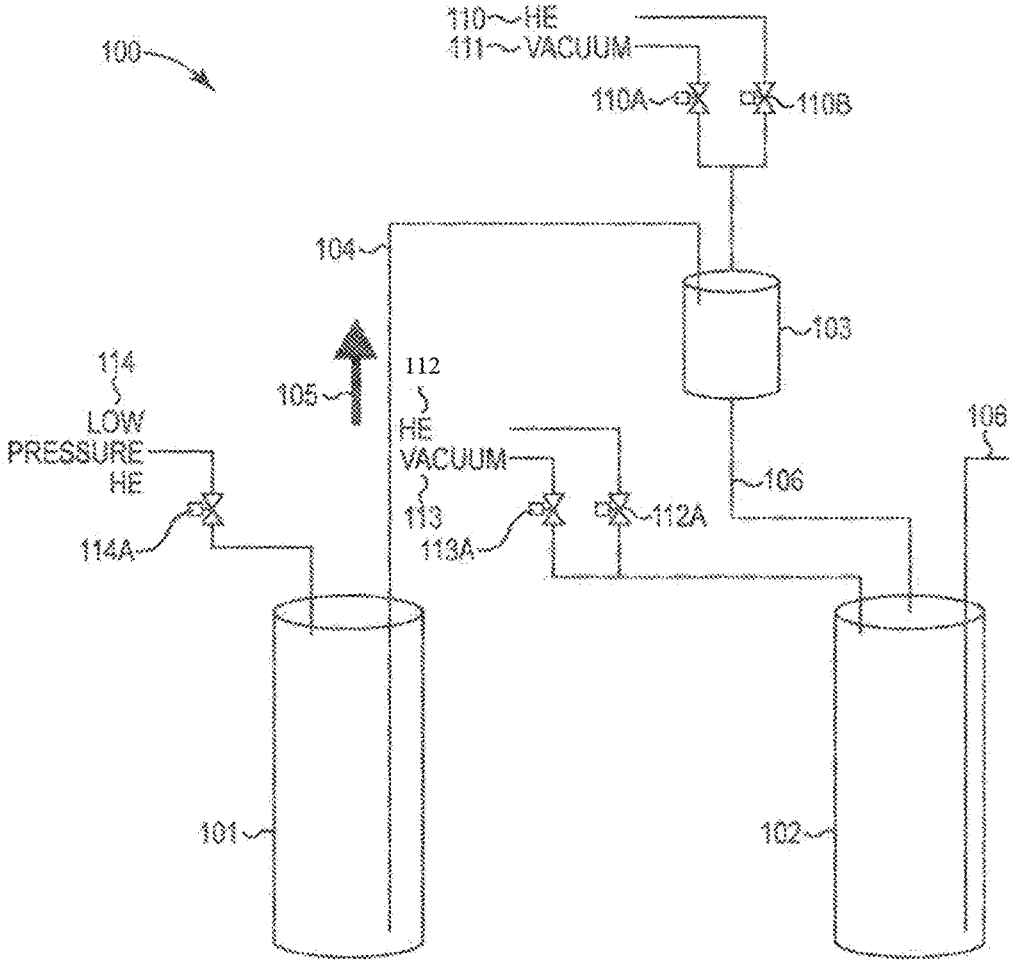
FIG. 1 is a perspective view of a fluid delivery system according one embodiment of the present disclosure.

The present disclosure relies to fluid delivery systems and methods incorporating a transfer vessel that functions as a pressure buffer between a bulk canister and a process canister. In some embodiments, the bulk canister may be transferred to the transfer vessel by vacuum, eliminating the need for high pressure rated stainless steel containers. The contents transferred to the transfer vessel may then be moved to a process canister under pressure. In other embodiments, the material of a bulk canister may be transferred to an intermediary transfer vessel (also referred to herein as a "reservoir") under a relatively low pressure. The material may then be transferred from the reservoir to a downstream process (tool, or process canister, for example) under a relatively higher pressure.

In one embodiment, a liquid delivery system utilizes an intermediate vessel (also variously referred to herein as the "transfer vessel") to transfer fluid from a bulk canister (also referred to herein as a "bulk storage vessel", or a "tote") to a process canister using vacuum and pressure cycling to effect corresponding fluid flows. In some embodiments, a vacuum coupled with the transfer vessel draws fluid from the bulk canister (or source container of any suitably desired material, shape, size, etc.) without requiring the bulk storage vessel to be pressurized, thereby avoiding the requirement that the bulk canister be a pressure-rated stainless steel canister. This in turn allows the bulk canister to be a low-cost, non-pressure-rated vessel that delivers fluid to a pressurized process canister without adverse effect on the delivery of fluid to a location of use. The ability to supply liquids from such non-pressure-rated vessels or canisters allows for the specific container to be selected based on fluid and/or transport requirements, a distinct and cost-effective benefit in applications in which stainless steel is not an optimal choice. In various embodiments, alternative containers may be provided that include, without limitation, sand-alone containers that may be rigid, semi-rigid, collapsible, and/or foldable for example, plastic vessels, glass bottles, and collapsible liners, for example "bag in box" or "bag in bottle" containers, which may include a liner disposed within an overpack. As used herein, the terms "canister" and "vessel" generally refer to any container, package, and/or closable enclosure capable of holding fluid. Accordingly, a "canister," or "vessel" may include a liner and/or an overpack, in some embodiments.

Further examples of the types of liners and/or overpacks that may be used with embodiments of the present disclosure for any of the containers described herein, including the bulk canister, the transfer vessel, and/or the process canister are described in greater detail in International PCT Appl. No. PCT/US2012/070866, entitled, "Liner-Based Shipping and Dispensing Systems," filed, Dec. 20, 2012; International PCT Appl. No. PCT/US11/55558, titled, "Substantially Rigid Collapsible Liner, Container and/or Liner for Replacing Glass Bottles, and Enhanced Flexible Liners," filed Oct. 11, 2011, International PCT Appl. No. PCT/US11/55560, titled, "Nested Blow Molded Liner and Overpack and Methods of Making Same," filed Oct. 10, 2011; U.S. Prov. Appl. No. 61/468,832, titled "Liner-Based Dispenser," filed Mar. 29, 2011; U.S. Prov. Appl. No. 61/525,540, titled "Liner-Based Dispensing Systems," filed Aug. 19, 2011; U.S. patent application Ser. No. 11/915,996, titled "Fluid Storage and Dispensing Systems and Processes," filed Jun. 5, 2006; International PCT Appl. No. PCT/US10/51786, titled "Material Storage and Dispensing System and Method With Degassing Assembly," filed Oct. 7, 2010, International PCT Appl. No. PCT/US10/41629, U.S. Pat. No. 7,335,721, U.S. patent application Ser. No. 11/412,629, U.S. patent application Ser. No. 12/302,287, and international PCT Appl. No. PCT/US08/85264, each of which is hereby incorporated by reference herein in its entirety.

In some embodiments, one or more of the containers used in accordance with the present disclosure may generally include a liner comprising a tube-shaped body portion, a top portion that includes a fitment, and a bottom portion that defines an enclosed interior for holding a material, examples of which are described in greater detail in International PCT Appl. No. PCT/US2011/064141, entitled, "Generally Cylindrically-Shaped Liner for Use in Pressure Dispense Systems and Methods of Manufacturing the Same," filed Dec. 9, 2011, which is hereby incorporated herein in its entirety.

Still further liners and/or overpacks that may be used in conjunction with certain embodiments of the present disclosure include substantially rigid collapsible containers and flexible containers that may include fold lines or fold patterns defining a collapse pattern. In some embodiments, some such containers may be blow-molded, substantially rigid collapsible containers with fold lines that may be suitable for storage and dispensing systems and may be of virtually any size from about 1 Liter or less to about 200 Liters or more. The substantially rigid collapsible container may be a stand-alone container, e.g., used without an outer container, and may be dispensed by any suitable means, including by using a pump or a pressurized fluid, or a combination thereof. In some embodiments, the container walls may be manufactured using at least one polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylene (HDPE), and polypropylene (PP). In some embodiments, two opposing side walls of the container may include predetermined fold lines that upon collapse of the container, cause the opposing side walls to gusset inward. A more detailed description of examples of this general type of container are provided in International PCT Appln. No. PCT/US2012/051843, entitled, "Substantially Rigid Collapsible Container with Fold Pattern," filed Aug. 22, 2012; and U.S. Provisional Patent Appln. No. 61/7729,766, entitled, "Substantially Rigid Foldable Container," filed, Nov. 26, 2012, both of which are hereby incorporated herein in their entirety.

Embodiments of canisters and vessels of the present disclosure that may include liners and/or overpacks may include any of the embodiments, features, and/or enhancements disclosed in any of the above noted applications, including, but not limited to, flexible, rigid collapsible, 2-dimensional, 3-dimensional, welded, molded, gusseted, and/or most-gusseted liners, and/or liners that contain folds and/or liners that comprise methods for limiting or eliminating choke-off and liners sold under the brand name NOWpak® by ATMI, Inc. for example. In addition, various features of dispensing systems disclosed in embodiments described herein may be used in combination with one or more other features described with regard to other embodiments.

While various embodiments of the present disclosure are described as containing materials for use in the semiconductor industry, it will be understood that embodiments of the present disclosure may be used to store and/or dispense any suitable material. Examples of some of the types of materials that may be stored, shipped, and/or dispensed using embodiments of the present disclosure include, but are not limited to: ultrapure liquids, such as acids, solvents, bases, photoresists, slurries, detergents, cleaning formulations, dopants, inorganic, organic, metalorganics, TEOS, and biological solutions, DMA and RNA solvents and reagents, pharmaceuticals, printable electronics inorganic and organic materials, lithium ion or other battery type electrolytes, nanomaterials (including for example, fullerenes, inorganic nanoparticles, sol-gels, and other ceramics), and radioactive chemicals; pesticides/fertilizers; paints/glosses/solvents/coating-materials etc.; adhesives; power washing fluids; lubricants for use in the automobile or aviation industry, for example; food products, such as but not limited to, condiments, cooking oils, and soft drinks, for example; reagents or other materials for use in the biomedical or research industry; hazardous materials used by the military for example; polyurethanes; agrochemicals; industrial chemicals; cosmetic chemicals; petroleum and lubricants; sealants; health and oral hygiene products and toiletry products; or any other material that may be dispensed by pressure dispense, for example. Materials that may be used with embodiments of the present disclosure may have any viscosity, including high viscosity and low viscosity fluids. Those skilled in the art will recognize the benefits of the disclosed embodiments, and therefore will recognize the suitability of the disclosed embodiments to various industries and for the transportation and dispense of various products. In some embodiments, the storage, shipping, and dispensing systems may be particularly useful in industries relating to the manufacture of semiconductors, flat panel displays, LEDs, and solar panels; industries involving the application of adhesives and polyamides; industries utilizing photolithography technology; or any other critical material delivery application. For example, uses of such containers/vessels of the present disclosure may include, but are not limited to, transporting and dispensing ultrapure chemicals and/or materials such as photoresist, bump resist, cleaning solvents, TARC/BARC (Top-Side Anti-Reflective Coating/Bottom-Side Anti-Reflective Coating), low weight ketones and/or copper chemicals for use in such industries as microelectronic manufacturing, semiconductor manufacturing, and flat panel display manufacturing, for example. Additional uses may include, but are not limited to, transporting and dispensing acids, solvents, bases, slurries, cleaning formulations, dopants, inorganics, organics, metalorganics, TEOS, and biological solutions, pharmaceuticals, and radioactive chemicals. However, such containers may further be used in other industries and for transporting and dispensing other products such as, but not limited to, paints, soft drinks, cooking oils, agrochemicals, health and oral hygiene products, and toiletry products, etc. Those skilled in the art will recognize the benefits of such containers and the process of using and manufacturing the same, and therefore will recognize the suitability of the liners for use in various industries and for the methods of dispense of various products.

Any of the containers, vessels, overpacks and/or liners of the present disclosure may be comprised of any suitable material or combination of materials, for example, but not limited to, metal materials, or one or more polymers, including plastics, nylons, EVOH, polyesters, polyolefins, or other natural or synthetic polymers. In further embodiments, the containers may be manufactured using polyethylene terephthalate (PET), polyethylene naphthalate (PEN), poly (butylene 2,6-naphthalate) (PBN), polyethylene (PE), linear low-density polyethylene (LLDPE), low-density polyethylene (LDPE), medium-density polyethylene (MDPE), high-density polyethylen (HDPE), polypropylene (PP), and/or a fluoropolymer, such as but not limited to, polychlorotrifluorothylene (PCTFE), polytetrafluoroethylene (PTFE), fluorinated ethylene propylene (FEP), and perfluoroalkoxy (PFA). The container may be of any suitable shape or configuration, such as, but not limited to, a bottle, a can, a drum, etc.

Figure 2A:
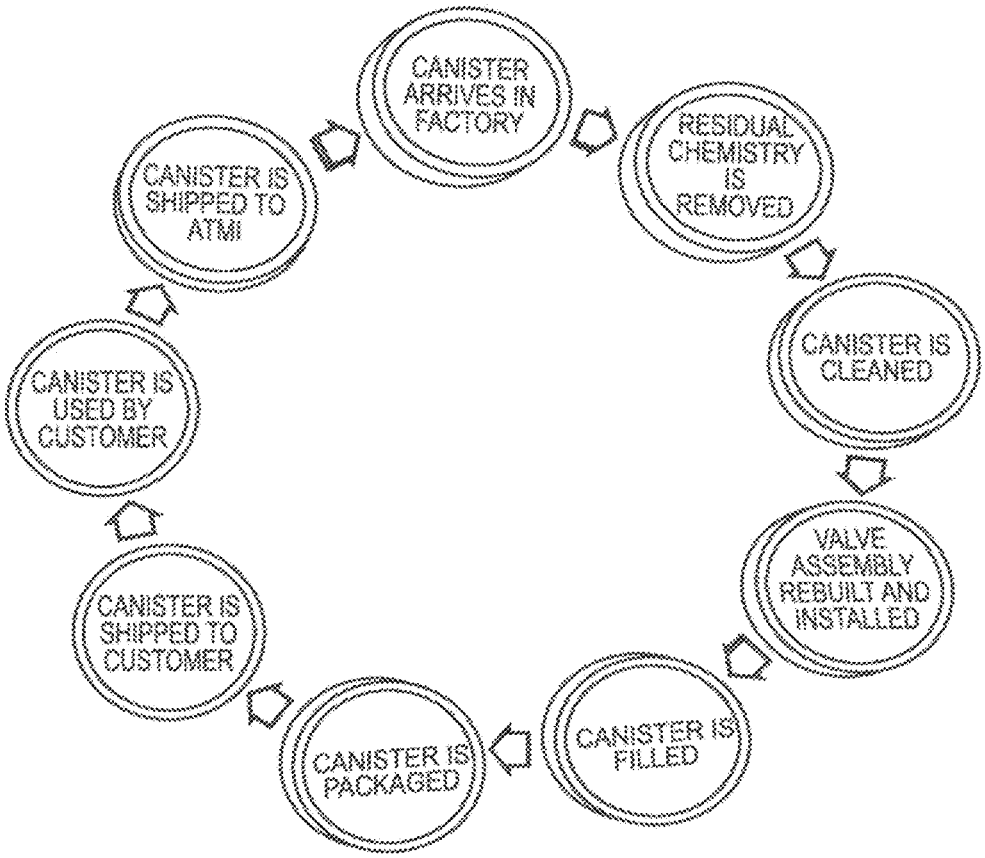
FIG. 2A is a flow chart illustrating steps entailed in lifecycle processing and deployment of conventional fluid supply canisters.
Figure 2B:
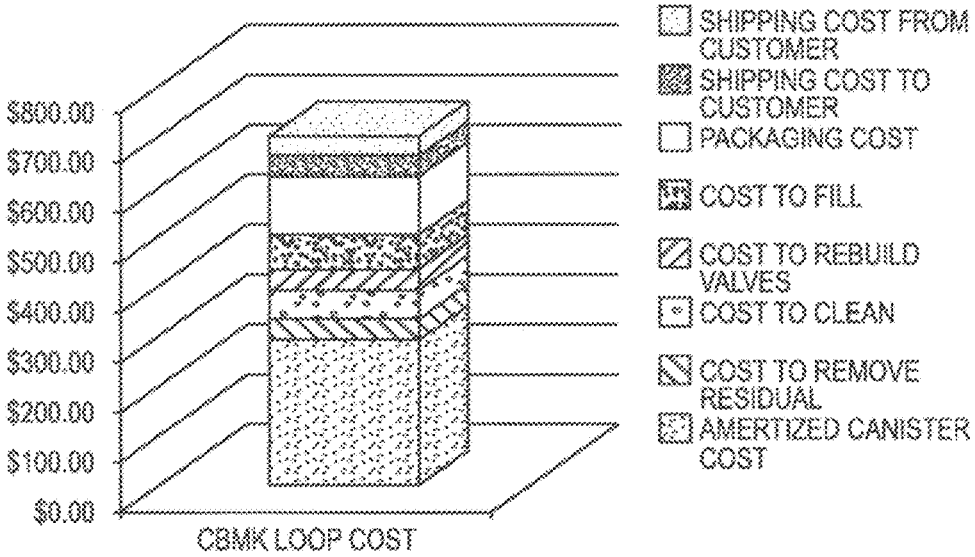
FIG. 2B is a chart identifying components of the costs of maintaining the conventional fluid supply canisters of FIG. 2A in service.
Figure 3:
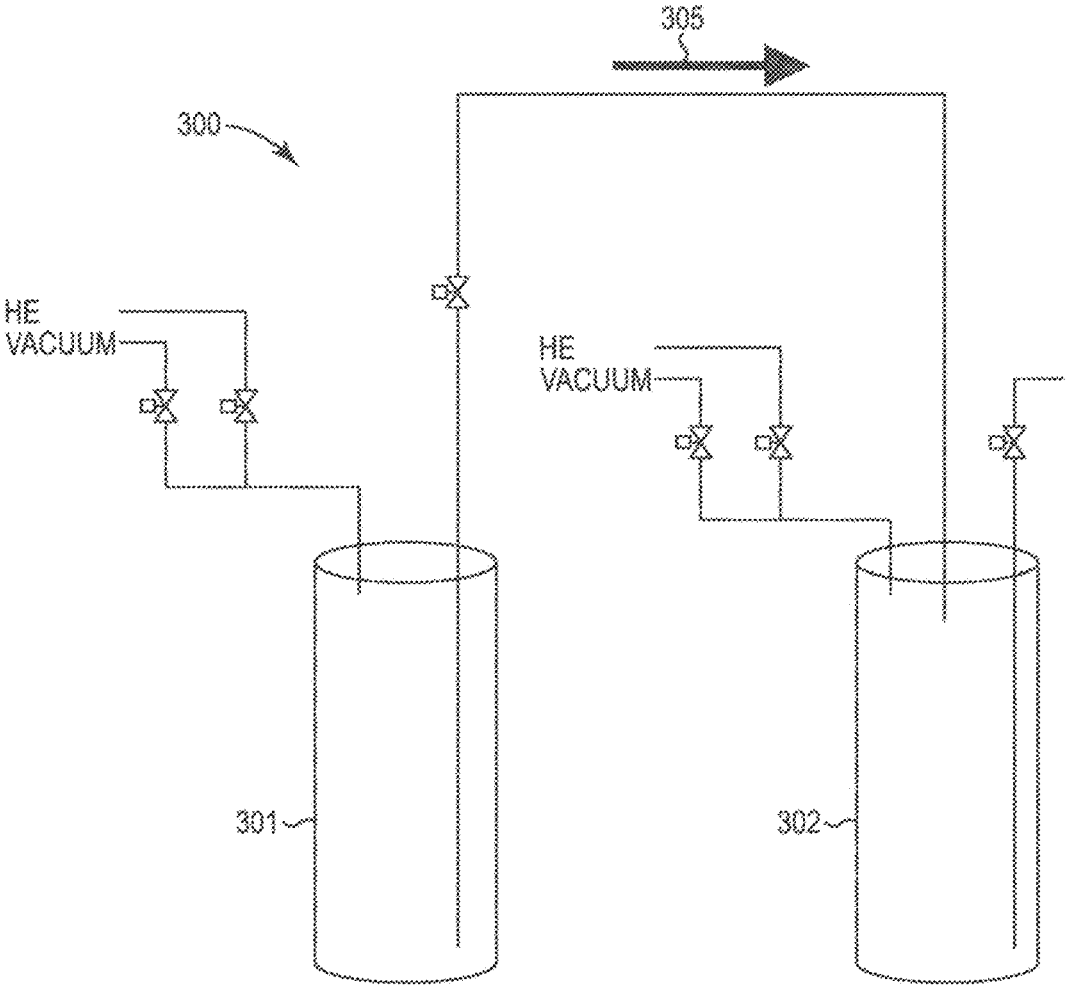
FIG. 3 is a perspective schematic view of a conventional fluid delivery system used in semiconductor fluid supply operations.
Figure 4A:
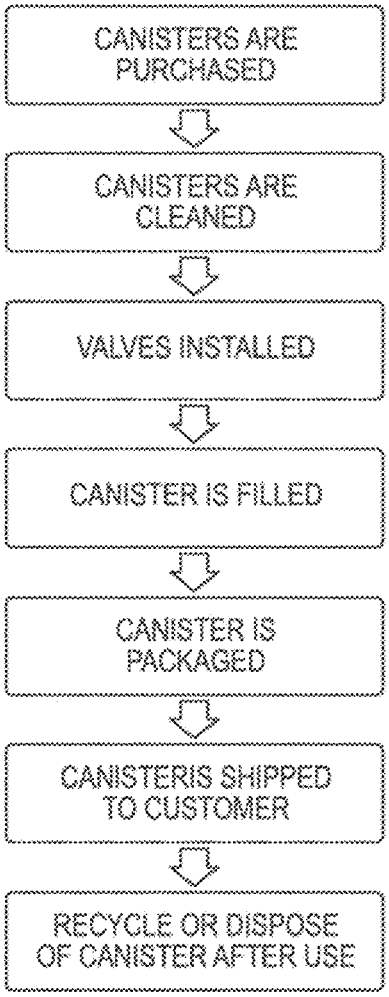
FIG. 4A is a flow chart of lifecycle processing and deployment steps, for fluid supply canisters according to one embodiment of the present disclosure.

The fluid supply system of the present disclosure enables packaging of fluids based on transport and chemical requirements, without constraint of the strict compatibility requirements that have constrained the efficiency and cost-effectiveness of prior delivery systems. Further, as previously mentioned, conventional fluid supply canisters require a lifecycle management process involving their return to the supplier for reconditioning and refilling. The approaches of the present disclosure enable canisters to be employed that are made of recyclable and/or disposable materials, thereby eliminating the need for such vessels to be returned to the supplier. This in turn breaks the conventional life management cycle illustrated in FIG. 2A and enables such use/return/recondition/refill/delivery cycle to be replaced with a one-way canister supply scheme of a type as illustratively shown in FIG. 4A. Such change in the canister lifecycle management process enables dramatic savings to be achieved, as for example is shown by the cost component chart of FIG. 4B.

In various embodiments, the transfer vessel is smaller in size (volumetric capacity) that either of the bulk canister and process canister. Such size differential allows the transfer vessel to remain at vacuum conditions until refilling of the process canister is required. This in turn minimizes the occurrence of dissolved gas in the fluid. The transfer vessel in various embodiments can be connected to a standard pressure canister, thereby maintaining backward compatibility. In various embodiments, the system disclosed herein may be adapted to any desired canister system, and is compatible with any container, package, receptacle or enclosure that is capable of holding fluid.

In various embodiments, the systems and methods of the present disclosure eliminate the need for costly and failure-prone liquid level seniors (e.g., float sensors) that are utilized for empty detection ("end point detectors"). In one embodiment, the float sensor may be eliminated by an approach in which a pressure change vs. time algorithm used to determine the empty condition of the canister. In one embodiment, a pressure transducer is provided to sense pressure of the fluid in the bulk canister and responsively generate a transducer output indicative of such pressure. A processor may be adapted to receive such transducer output and determine rate of change of pressure of the fluid to provide a processor output indicative of an increased rate of change correlative to onset of exhaustion of fluid in the bulk canister. Such pressure transducer monitoring system and method may be utilized on any canister or vessel of the fluid supply system, including, but not limited to, the bulk canister, the transfer vessel, and the process canister.

In other embodiments, any suitable level monitoring method may be employed with any of the canisters of the present disclosure. For example, means for controlling dispense of fluid from a container and determining when a container nears empty are described in U.S. Pat. No. 7,172,096, entitled "Liquid Dispensing System," issued Feb. 6, 2007 and PCT Application Number PCT/US07/70911, entitled "Liquid Dispensing Systems Encompassing Gas Removal," with an international filing date of Jun. 11, 2007, each of which is hereby incorporated herein by reference in its entirety, and International Patent Application No. PCT/US2011/055558, previously incorporated by reference in its entirety. In this regard, some embodiments, the dispensers may include any suitable level sensing features or sensors. Such level sensing features or sensors may use visual, electronic, ultrasonic, or other suitable mechanisms for identifying, indicating, or determining the level of the contents stored in the dispensers.

In further embodiments, flow metering technology may be integrated into or operably coupled with a means for directly measuring the material being delivered from the first canister to the transfer vessel and/or from the transfer vessel to the downstream canister or process. A direct measurement of the material being delivered could provide the end user with data which may help ensure process repeatability or reproducibility. In one embodiment, the flow meter may provide an analog or digital readout of the material flow. The flow meter, or other component of the system, can take the characteristics of the material (including but not limited to viscosity and concentration) and other flow parameters into consideration to provide an accurate flow measurement. Additionally, or alternatively, the flow meter can be configured to work with, and accurately measure, a specific material stored and dispensed from the dispenser. In one embodiment, the inlet pressure can be cycled, or adjusted, to maintain a substantially constant outlet pressure or flow rate.

In various embodiments, the combination of a transfer vessel and an end point monitoring method will enable substantially the entire fluid inventory in the system to be utilized without leaving any significant remaining amount in the bottom of the container (such residual fluid being commonly referred to as "a heel"). The transfer vessel system thereby avoids the occurrence of significant amounts of entrained gas being present in the liquid, as is typically observed in the operation of conventional high pressure fluid supply systems.

In one embodiment, a fluid supply system is adapted for vacuum and pressure cycling of fluid and includes a process canister adapted for delivery of fluid to a location of use (e.g., in a semiconductor processing tool), and a transfer vessel adapted to supply the process canister with fluid from at least one bulk canister, wherein the transfer vessel is coupled with (i) a vacuum source for drawing fluid from at least one bulk canister into the transfer vessel and selectively maintaining a vacuum condition in the at least one bulk canister, and (ii) a first source of pressurizing gas for pressure-mediated transfer of fluid from the transfer vessel into the process canister.

In the operation of the systems and methods of the present disclosure, vacuum is selectively maintained to preclude entrainment of gas in the fluid being supplied. In various embodiments, the transfer vessel will cycle between a vacuum state and a pressure state. In the vacuum state, the amount of vacuum is selectively adjusted to either (1) draw fluid from the bulk canister, or (2) maintain at least a minimal vacuum in the bulk canister to controllably minimize the occurrence of gas entrainment. In one embodiment, the vacuum state can be selectively terminated (e.g., by closing a valve in a fluid flow line interconnecting the transfer vessel and bulk container), so that pressure is thereupon or subsequently applied to the transfer vessel to effect displacement of the fluid from the vessel into the process canister. In various embodiments of the present disclosure, a process container may be maintained in a non-empty state by supply of fluid from a bulk canister via a transfer vessel, such that processes utilizing such fluid can be run continuously.

In one embodiment, a method of delivering fluid for use thereof is carried out, which includes drawing fluid under vacuum from a bulk canister into a transfer vessel, pressurizing the transfer vessel to force dispensing of the fluid to a process canister, and supplying gas to the process canister to effect delivery of fluid to a location of use, wherein gas supplied to the process canister is at a lower pressure than gas supplied to the transfer vessel. Further steps may include any of: (1) closing a valve between the at least one bulk container and the process container; (2) terminating the drawing of fluid under vacuum; (3) maintaining pressure in the process canister for constant supply of fluid; (4) reducing an amount of entrained gas, e.g., air, in the fluid of the at least one bulk canister by maintaining a negative pressure in the at least one bulk canister; and (5) sensing a signal from a pressure transducer in the at least one bulk canister indicative of an increased rate of change of pressure correlative to onset of exhaustion of fluid in the at least one bulk canister.

The transfer vessel may be pressurized at a greater pressure than the process canister (which is generally maintained at a constant pressure for continuous supply of fluid to a location of use) so that fluid may be delivered to the process canister from the transfer vessel. Once the transfer vessel has completed the delivery of fluid, the vessel connection to the process canister may optionally be terminated and a vacuum created in connection with the bulk canister to either (1) draw fluid from the bulk canister, or (2) maintain at least a minimal vacuum in the bulk canister to minimize entrainment of gas. This cycling of the transfer vessel from vacuum to pressure (pressurized condition) is one embodiment of the present disclosure.

Thus, the fluid supply system and method of the disclosure can be implemented in a wide variety of ways, to achieve supply of fluid in an efficient manner, overcoming deficiencies of prior fluid supply systems and methods heretofore employed in semiconductor manufacturing and other fluid utilization applications.

In one implementation, the fluid supply system is adapted for vacuum and pressure cycling fluid, and includes, a process canister adapted for delivery of fluid to a location of use; and a transfer vessel adapted to supply the process canister with fluid from at least one bulk canister, wherein the transfer vessel is coupled with (i) a vacuum source arranged for drawing fluid from at least one bulk canister into the transfer vessel and selectively maintaining a vacuum condition in the at least one bulk canister, and (ii) a first source of pressurizing gas arranged for pressure-mediated transfer of fluid from the transfer vessel into said process canister.

In one embodiment of such fluid supply system, the process canister is coupled with a second source of pressurizing gas for pressure-mediated delivery of fluid to the location of use. In one implementation of such fluid supply system, the first source of pressurizing gas is arranged to create greater pressure than the second source of pressurizing gas.

The system can be arranged so that the at least one bulk canister is coupled with a third source of pressurizing gas arranged to selectively counter-balance the vacuum condition.

The at least one bulk canister in the above-described system can be fabricated of any suitable material of construction, and such bulk canisters can be stainless steel vessels, plastic vessels, glass bottles, collapsible liners, or any other suitable canisters types or constructions, or any of the other suitable canisters or vessels described above.

In one embodiment, the system is constituted to further comprise at least one pressure transducer adapted to sense pressure of fluid in the at least one bulk canister and produce a transducer output indicative of the said pressure. A processor is provided that is adapted to receive the transducer output and responsively determine rate of change of pressure of the fluid and provide a processor output indicative of an increased rate of change correlative to onset of exhaustion of fluid in the at least one bulk canister, when the at least one bulk canister is at onset of exhaustion of fluid.

The system in another embodiment can be constituted so that the fluid holding volume of the transfer vessel is less than fluid holding volume of any one of the at least one bulk canister and the process canister.

The location of use in the deployment of the above-describe system can be any suitable location wherein the supplied fluid is utilized, e.g., to perform a process, treatment, or other utilization function. In one embodiment, the location of use comprises a semiconductor manufacturing location, which may for example comprise a semiconductor manufacturing tool in Which the supplied fluid is utilized, such as for deposition, ion implantation, etching, or other fluid-using operation or process.

In respect of the previously described deficiency of stainless steel vessels as being incompatible with specific chemical reagents, the fluid supply system of the present disclosure may be constituted to include non-stainless steel vessels, thereby obviating such deficiency prior fluid supply systems. Accordingly, in one embodiment, at least one of the at least one bulk canister, transfer vessel and process canister is of non-stainless steel construction. In another specific embodiment, at least one bulk canister of the fluid supply system is of non-stainless steel construction.

The disclosure relates in another aspect to a method of delivering fluid for use thereof, the method comprising, drawing fluid under vacuum from at least one bulk canister into a transfer vessel; pressurizing the transfer vessel to force dispersing of the fluid to a process canister; and supplying gas to the process canister to effect delivery of fluid to a location of use, wherein gas supplied to the process canister is at a lower pressure than gas supplied to the transfer vessel.

Such method may further comprise any one or more of:

closing a valve disposed in a fluid flow line between the at least one bulk container and the process container;

terminating the drawing of fluid under vacuum;

maintaining sufficient pressure in the process canister to effect a constant supply of fluid to the location of use;

reducing an amount of entrained gas in fluid in the at least one bulk canister by maintaining a negative pressure in the at least one bulk canister; and sensing a signal from a pressure transducer in the at least one bulk canister indicative of an increased rate of change of pressure correlative to onset of exhaustion of fluid in the at least one bulk canister, when said at least one bulk canister is at onset of exhaustion of fluid.

The method may be conducted, wherein the at least one bulk canister comprises any one of a stainless steel vessel, a plastic vessel, a glass bottle, or a collapsible liner, or any other canister described and/or incorporated by reference herein.

The method may entail the use of at least one bulk canister, transfer vessel and process canister, in which the fluid holding volume of the transfer vessel is less than fluid holding volume of any one of the at least one bulk canister and the process canister.

The method may be implemented with the location of use of the supplied gas being a semiconductor manufacturing location, e.g., a semiconductor manufacturing tool.

The canisters and transfer vessel utilized in carrying out the method can be of any suitable materials of construction. In one implementation, at least one of the bulk canister, the transfer vessel and process canister is of non-stainless steel construction.

The method in another variation can further comprise sensing pressure of fluid in the at least one bulk canister and responsively generating a transducer output indicative of the pressure, determining from the transducer output the rate of change of pressure of the fluid, and determining onset of exhaustion of fluid in the at least one bulk canister from the rate of change of pressure of the fluid in the at least one bulk canister.

The advantages and features of the disclosure are further illustrated with reference to the following example, which is not in any way to be construed as limiting the scope of the disclosure but rather as being illustrative of one embodiment of the disclosure, in a specific application thereof.

A system 100 of the type shown schematically in FIG. 1 may be employed in accordance with one embodiment of the present disclosure, incorporating a bulk canister 101 for the supply of fluid (not shown), a transfer vessel 103 that is coupled to a gas vacuum source 110 and a pressurizing gas source 111, and a process canister 102. The vacuum source 110 is activated (via valve 110A) to draw fluid from the bulk canister 101 through a line 104 in a direction indicated by the arrow 105 and into the transfer vessel 103. Once a desired amount of fluid is drawn into the transfer vessel 103 under a vacuum, the line 104 connecting the bulk canister 101 to the transfer vessel 103 may be closed (via a suitable valve, not shown), and a pressurizing gas source 111 is activated (via a gas valve 110B) to drive the fluid in the transfer vessel 103 through line 106 upon the opening of a valve (not shown) and into the process canister 102. The process canister 102 may be optionally maintained at a consistent pressure, so that fluid may be constantly supplied through line 106, when a valve (not shown) is opened, to a point of use (not shown—e.g., a semiconductor tool). Therefore, the pressure applied to the transfer vessel 103 from the pressurizing gas source 111 may be greater than the pressure in the process canister 102 from a pressure source 112 applied (via a gas valve 112A) thereto so that fluid may be delivered from the transfer vessel 103 into the process canister 102 for further delivery to a point of use. The process canister 102 may also be optionally coupled with a vacuum source 113 (via a valve 113A). Optionally, a low pressure source 114 may be supplied (via valve 114A) to the bulk canister 101 for counterbalancing the vacuum source 110 of the transfer vessel 103, or to aid in evacuating the fluid from the bulk canister 101. In various embodiments, the transfer vessel 103 is smaller in size than the process canister 102 and bulk canister 101.

Figure 4B:
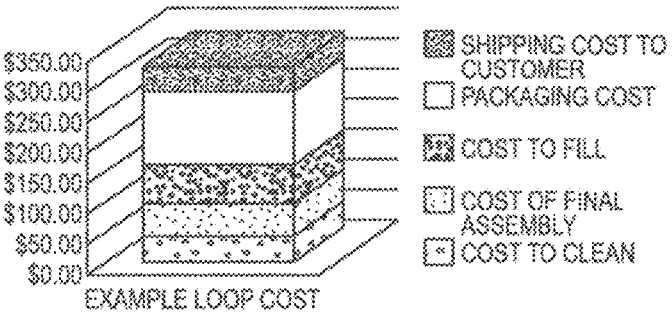
FIG. 4B is a chart identifying components of the costs of maintaining the fluid supply canisters of FIG. 4A in service.

The system of the general type disclosed in FIG. 1 will allow for any type of canisters, containers, or vessels to be utilized that are sufficient to retain a desired fluid, and enable disposal or recycling of the container by a user at a point of use. This may in turn eliminate the need for returning containers to a supplier of fluid for reprocessing and filling, and may instead allow for a one-way supply of canisters as shown in the illustrative flowchart of FIG. 4A. Such one-way supply arrangement also eliminates significant costs as is shown in FIG. 4B.

In addition to embodiments described above, some of which may eliminate the need for expensive and problematic pressure rated stainless steel canisters, further embodiments will be described, which may also obviate the need for using stainless steel canisters and additionally eliminate the need for pump systems in order to transfer material from a bulk container to the transfer vessel. According to such embodiments, in general, a relatively low pressure may be used to transfer material from a bulk canister ("tote") to a transfer vessel ("reservoir"), the relatively low pressure may be selected such that gas entrainment or saturation is reduced or minimized, thereby having little or generally insignificant effect on bubble formation in the material. Pressurizing the tote to such a relatively low degree, for example 120 kPA (3 psig) or less, may obviate the need to use a pressure rated stainless steel canister as the tote, thereby permitting use of substantially any type of suitable container, such as those described and incorporated herein, for the tote. Further, utilizing pressure dispense to transfer material from the tote to the transfer vessel eliminates the need for any pump system, and thus eliminates many complicated pump components that require routine cleaning, further reducing system cost and maintenance.

Figure 5:
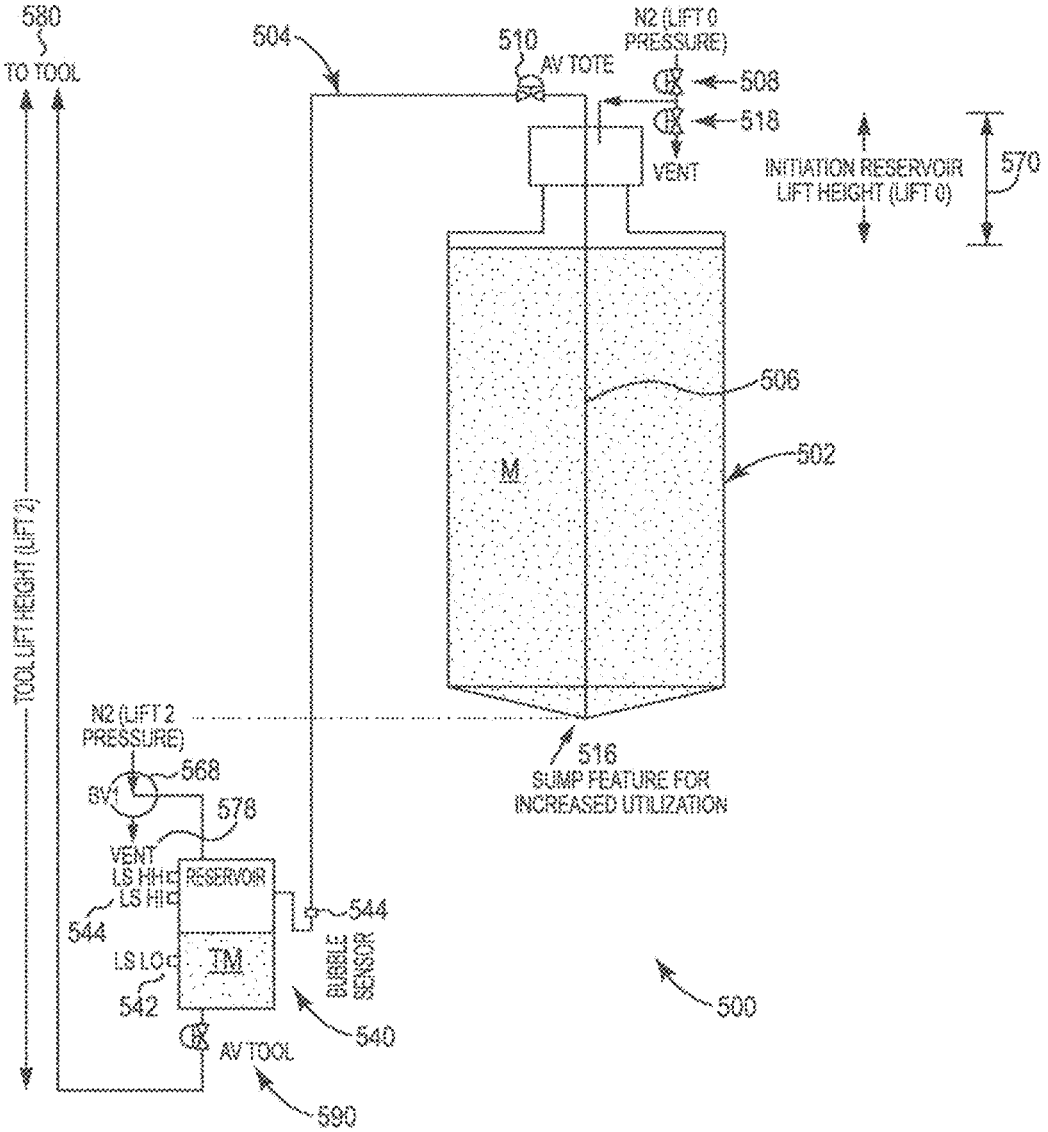
FIG. 5 is a perspective view of a fluid delivery system according to another embodiment of the present disclosure.

More specifically, FIG. 5 shows an embodiment of a system and method 500 for dispensing contents of a bulk canister or tote 502 via an intermediary vessel or reservoir 540 and onto a downstream process or tool, which may further include a processing canister as described with respect to the embodiments of FIG. 1 but not illustrated in FIG. 5. The tote 502 may be filled with a material M. In some embodiments, the tote 502 may include a dip tube 506. The tote may also include a sump 516 in some embodiments, to increase or maximize the amount of material M that may be dispensed via the dip tube 506, as will be understood by those skilled in the art. In other embodiments, the tote 502 may also include any other features, or combinations of features described or incorporated by reference herein that may be considered beneficial. A pressurizing gas source 508 may be operably coupled to the tote 502, whereby the gas may be introduced into the interior of the tote 502 for pressure dispense of the material M therein. Any suitable gas may be used as a gas source, and in some embodiments, for example, nitrogen may be used. However, other suitable gases, such as but not limited to, helium or argon may be used. In the embodiment shown, the dispense may be by direct pressure dispense, meaning that the gas is introduced directly into the space housing the material M, resulting in the contents of the tote 502 being forced up through the dip tube 506, if one is provided, and out of the tote. However, the tote is not limited to being configured for direct pressure dispense, and in other embodiments, the tote may be a liner-based system, comprising a liner within an overpack as described above and in references incorporated herein, and the system may be configured for indirect pressure dispense of the material M from the liner of the tote by applying a pressure to an annular space between the liner and overpack, the overpack acting as a pressure vessel for the liner.

Likewise, a stand-alone tote may be similarly configured for placement in an existing system pressure vessel, wherein the tote may be dispensed using indirect pressure by applying a pressure to a space between the pressure vessel and tote. However, it is recognized that there is often a limit to the size of canisters or containers that can be easily positioned within a pressure vessel. Accordingly, relatively large bulk containers or totes may not be suitably configured for indirect pressure dispense.

A primary concern with direct pressure dispense, however, is the potential for gas entrainment or saturation, i.e. the creation of micro-bubbles in the liquid material, which in significant quantities may be harmful to the material and/or render the material unusable. The micro-bubbles that may form are created from the disturbance caused by the gas source being applied directly to the material. As may be apparent, the greater the pressure applied to the liquid, the greater the disruption that occurs, and the greater the risk that a significant amount of micro-bubbles will form in the material. This concern becomes greater when the material is exposed to the pressure for extended periods of times, which is often the case with relatively large bulk containers and totes. It has been found that at lower dispense pressures however, very few micro-bubbles may form. For example, at values generally below 120 kPA (3 psig), there may be little, e.g., generally insignificant micro-bubble formation. In this regard, according to some embodiments of the present disclosure, the material M may be transferred from the tote 502 utilizing pressure dispense, at a pressure of generally around or below 120 kPA (3 psig). Even over extended periods of time, the material M will only achieve relatively low saturation, and the effects of bubble formation in the material will generally be insignificant, or will generally be non-detrimental, for most applications.

A vent 518 may be operably coupled to the tote 502, in order to relieve pressure on the contents M of the tote 502, if desired. A transfer line 504 may allow the contents M of the tote 502 to be transferred to the reservoir 540 under pressure dispense, as described above. A tote valve 510 may be provided in order to control flow of the material M from the tote 502 to the reservoir 540, such that when the tote valve is in a first position, the material M may generally flow freely, and when the tote valve is in a second position, the material M may be prohibited from flowing from the tote to the reservoir. It will be understood, however, that the tote valve 510 may also allow for a plurality of intermediate options other than or in addition to simple on/off, including, for example, controlling the rate of flow of material, for example.

As may be seen in FIG. 5, the reservoir 540 may generally be smaller than the tote 502, and in some cases may be considerably smaller than the tote. The reservoir 540 may be the same type of container as the tote 502, or may be of a different type, and/or made of a different material. For example, in some embodiments, the tote 502 may be a stand-alone, at least semi-rigid container, while the reservoir 540 may include a permanently fixed, rigid vessel or fixture of the dispensing process. As previously described, any of the containers of the present disclosure, including totes and reservoirs, may be configured in any manner described or incorporated by reference herein. Like the transfer vessel described with respect to FIG. 1, the reservoir 540 may apply pressure to dispense to dispense a material TM from within the reservoir to a downstream end user process or tool 580, which as stated above, may but does not require one or more processing canisters.

In this regard, a gas pressurizing source 568 may be operably coupled to the reservoir 540 in order to transfer the material TM in the reservoir to the end user process or tool 580 via pressure dispense. In some embodiments, like that shown in FIG. 5, the gas source applying gas to the tote may be separate from the gas source applying gas to the reservoir. However, in other embodiments, the same gas source may be used to apply gas to the tote as is used to apply gas to the reservoir. A vent 578 may also be operably coupled to the reservoir 540 to relieve any excess pressure on the contents TM of the reservoir 540. A tool valve 590 may be included in the system that, similar to the tote valve 510, may control the flow of material TM from the reservoir 540 to the tool 580, such that when the tool valve is in a first position, the material TM may generally flow freely, and when the tool valve is in a second position, the material TM may be prohibited from flowing from the reservoir to the tool. It will be understood, however, that the tool valve 590 may also allow for a plurality of intermediate options other than or in addition to simple on/off, including, for example, controlling the rate of flow of material, for example.

Dispensing from the reservoir 540 may typically include dispensing with a relatively higher pressure than that used to transfer the material M from the tote 502 to the reservoir, and will typically be greater than 120 kPA (3 psig), and in some embodiments, may be up to about 206.84 kPA (30 psi) or more. As stated above, a primary concern with pressure dispense, however, is the potential for gas entrainment or saturation, i.e. the creation of micro-bubbles in the liquid material, which in significant quantities may be harmful to the material and/or render the material unusable. Also recognized above, the greater the pressure applied to the liquid, the greater the disruption that occurs, and the greater the risk that a significant amount of micro-bubbles will form in the material. However, this concern is reduced when the material is exposed to the relatively high pressures for relatively short or minimal periods of times. As stated above, the reservoir 540 may generally be smaller than the tote 502, and in some cases may be considerably smaller than the tote. In this regard, in contrast to the extended amount of time it takes to deplete the tote 502, the reservoir may be emptied or cycled within relatively short periods of time, as an example only, typically within about 15-30 minutes. Accordingly, while a relatively higher pressure may be used to dispense the material TM from the reservoir 540 to the end user process or tool 580, the amount of time the material TM is exposed to the increased pressure is generally limited, thereby reducing or minimizing the effect of gas saturation and micro-bubble formation in the material TM.

In use, a bulk canister or tote 502 may be operably coupled with the transfer line 504 and pressurizing gas source 508. At any given time, to begin the process of filling the reservoir 540, the tote valve 510 may be opened and the gas source 508 may be turned on and/or the vent 518 may be closed, allowing the material M in the tote 502 to be pressurized and transferred to the reservoir via transfer line 504. Generally, in some embodiments, a relatively low pressure, for example, generally around or below 120 kPA (3 psig), may be used to transfer material M from the tote 502 into the intermediary reservoir 540. As illustrated in FIG. 5, and should be appreciated by those skilled in the art, if done properly, in some embodiments, the pressure applied need only be minimally sufficient to raise the material M a first lift height 570 from the top surface of the material to the top of the tote 502 and the highest point of the transfer line 504. If the tote 502 is positioned in a vertically higher position relative the reservoir 540, which may be the case in some embodiments, gravity and siphoning effects may be engaged and utilized one the initial lift height 570 has been reached. In this regard, only a relatively small amount of pressure may be required to begin and maintain the transfer or material M to the reservoir 540. In some cases, the pressure may be as low as about 1.0 psig or less, while in other cases, the pressure may be anywhere from about 1.0 psig to about 3 psig. In other embodiments, however, the tote 502 need not be positioned entirely in a vertically higher position relative the reservoir 540, and instead, the tote and reservoir may be physically arranged in any suitable fashion relative one another, including being substantially level with one another or with the tote positioned vertically lower than the reservoir or any position inbetween those described herein. Although, it is recognized that certain positioning may affect the amount of pressure required to transfer the material M from the tote 502 to the reservoir 540, and in some cases increase the amount of pressure required significantly.

In some embodiments, the transfer of material M from the tote 502 to the reservoir 540 may be configured to occur relatively quickly to help further reduce the likelihood of gas entrainment. It will be understood, however, that the transfer of material into the reservoir 540 from the tote 502 may be achieved over any suitable or desired time frame.

In some embodiment, a bubble sensor 544 may be included along the transfer line 504, at the input of the reservoir 540, or other suitable position, that may be used to detect the amount of bubbles in the transferred material M in a given period of time, which may be used, for example, to indicate whether the tote is nearing empty. However, any mechanism for determining when the tote 502 is nearing empty may be utilized, including any of the various methods and means for empty detect described and incorporated herein. In still another embodiment, the determination that the tote 502 is empty or nearing empty may be based on the amount of time it takes to fill the reservoir 540. For example, the amount of time it takes to fill the reservoir may increase over time due, for example, to the extra effort required to transfer the material M from the tote 502 when the tote is nearing empty. Once a certain predetermined amount of time as been reached, the tote 502 may be determined as nearing empty.

As will be appreciated, the material M may flow from the tote 502 to the reservoir 540. In some embodiments, sensors may be provided in the reservoir 540 for determining when the reservoir is substantially full and/or when the reservoir needs refilling. For example, in one embodiment, a high level sensor 544 may be used to detect when the material TM being filled from the tote has reached a certain height, typically being the position of the sensor, thereby indicating the reservoir is substantially full or has otherwise reached a level specified as full. Once the reservoir is filled with the specified amount of material TM, the tote valve 510 may be closed, thereby preventing further transfer of the material M to the reservoir.

Subsequent filling of the reservoir 540, to transfer or dispense the material TM from the reservoir to the downstream end user process or tool 580, the gas reservoir vent 578, if provided, may be closed and/or the gas source 568 may be turned on and the tool valve 590 may be opened, thereby permitting transfer of the material TM to the end user process or tool 580. During transfer of material TM from the reservoir 540 to the ultimate dispense source 580, the reservoir 540 may be pressurized to a relatively higher pressure via the gas source 568. While any suitable pressure may be used, it will typically be greater than 120 kPA (3 psig), and in some embodiments, may be up to about 206.84 kPA (30 psi) or more. The amount of time the material TM takes to empty from the reservoir 540 during direct pressure dispense of the material TM, i.e. the amount of time the material TM is exposed to the relatively high pressure, may be relatively short to help reduce or minimize the risk of micro-bubble formation. The amount of time typically may depend on the selected size of the reservoir 540, the amount of pressure applied, and the specifications of the downstream end user process or tool 580. While the amount of time can be any suitable time, in some embodiments, the amount of time that the material TM in the reservoir 540 is exposed to the relatively high pressures may be in the range of about 15-30 minutes, for example.

As stated above, in some embodiments, sensors may be provided in the reservoir 540 for determining when the reservoir is substantially full and/or when the reservoir needs refilling. For example, in one embodiment, a low level sensor 542 may be used to detect when the material TM being dispensed from the tote has reached a certain low, typically being the position of the sensor, thereby indicating that the reservoir is ready to be refilled. Refilling of the reservoir 540 from the tote 502 may be initiated by first closing the tool valve 590 and turning off the gas source 568. Subsequently, the fill process described above may be performed again. This cycle may repeat as necessary during operation of the system.

Any embodiments of the present disclosure may include any of, or any combination of, features, enhancements, or properties such as, but not limited to features to prevent or reduce choke-off, surface features that may be included on one or more surfaces of a container, multiple layers including barrier layers, coatings, and/or sprays, sleeves that may fit over the exterior of the container, labels, features that may help control the collapse of the container during pressure or pressure-assisted pump dispense in a particular way, and/or handles for transportability, each of which may be further described in detail in PCT Application Number PCT/US11/55558; PCT Application Number PCT/US08/52506, entitled, "Prevention Of Liner Choke-off In Liner-based Pressure Dispensation System," with an international filing date of Jan. 30, 2008; PCT Application Number PCT/US11/55560, titled "Nested Blow Molded Liner and Overpack and Methods of Making Same," filed Oct. 10, 2011; U.S. Pat. No. 7,172,096, entitled "Liquid Dispensing System," issued Feb. 6, 2007; PCT Application Number PCT/US07/70911, entitled "Liquid Dispersing Systems Encompassing Gas Removal," with an international filing date of Jun. 11, 2007; U.S. Pat. No. 6,607,097, titled "Collapsible Bag for Dispensing Liquids and Method." filed Mar. 25, 2002; U.S. Pat. No. 5,851,579, titled "Collapsible Bag for Dispensing Liquids and Method," filed Jun. 26, 2003; U.S. Pat. No. 6,984,278, titled "Method for Texturing a Film," filed Jan. 8, 2002; and U.S. Pat. No. 7,022,058, titled "Method for Preparing Air Channel-Equipped Film for Use in Vacuum Package," filed Jun. 26, 2002, International PCT Appl. No. PCT/US11/64141, titled "Generally Cylindrically-Shaped Liner for Use in Pressure Dispense Systems and Methods of Manufacturing the Same," filed Dec. 9, 2011; U.S. Prov. Appl. No. 61/703,996, titled "Liner-Based Shipping and Dispensing Systems," filed Sep. 21, 2012; U.S. Prov. Appl. No. 61/468,832, titled "Liner-Based Dispenser," filed Mar. 29, 2011 and related International PCT Appln. No. PCT/US2011/061764, filed Nov. 22, 2011; U.S. Prov. Appl. No. 61/525,540, titled "Liner-Based Dispensing Systems," filed Aug. 19, 2011 and related International PCT Appln. No. PCT/US2011/061771, filed Nov. 22, 2011, U.S. patent application Ser. No. 13/149,844, titled "Fluid Storage and Dispensing Systems and Processes," filed May 31, 2011; U.S. patent application Ser. No. 11/915,996, titled "Fluid Storage and Dispensing Systems and Processes," filed Jun. 5, 2006; International PCT Appl. No. PCT/US10/51786, titled "Material Storage and Dispensing System and Method With Degassing Assembly," filed Oct. 7, 2010; International PCT Appl. No. PCT/US10/41629; U.S. Pat. No. 7,335,721; U.S. patent application Ser. No. 11/912,629; U.S. patent application Ser. No. 12/302,287; International PCT Appl. No. PCT/US08/85264; U.S. patent application Ser. No. 12/745,605, filed Feb. 15, 2011; U.S. Prov. Appln. No. 61/605,011, titled "Liner-Based Shipping and Dispensing System," filed Feb. 29, 2012; and U.S. Prov. Appln. No. 61/561,493, titled "Closure/Connectors for Liner-Based Shipping and Dispensing Containers," filed Nov. 18, 2011; each of which is hereby incorporated by reference herein in its entirety. The containers of the present disclosure may include any of the embodiments, features, and/or enhancements disclosed in any of the above noted applications. Similarly, various features of dispensing systems disclosed in embodiments described herein may be used in combination with one or more other features described with regard to other embodiments.

Additionally, while the use of a pump to dispense material from containers of the present disclosure may not be ideal because of the cost and maintenance associated therewith, in some embodiments, a pump may nonetheless be utilized as is conventional in some applications. However, additional pump features, such as a diaphragm or bellows, may be used in conjunction with the pump may be included to such conventional pump embodiments to help isolate the material in the reservoir from the cycling of gas. Alternately, various forms of pumps, for example a piston, syringe, peristaltic, or cam pump, may be used in place of the conventional pumps used in such systems in order to help isolate the material in the reservoir from the cycling of gas.

While the disclosure has been has been described herein in reference to specific aspects, features and illustrative embodiments, it will be appreciated that the utility of the disclosure is not thus limited, but rather extends to and encompasses numerous other variations, modifications and alternative embodiments, as will suggest themselves to those of ordinary skill in the field of the present disclosure, based on the description herein. Correspondingly, the invention as hereinafter claimed is intended to be broadly construed and interpreted, as including all such variations, modifications and alternative embodiments, within its spirit and scope.

What is claimed is:

1. A fluid supply system adapted for vacuum and pressure cycling of fluid, the system comprising:

at least one bulk canister;

a process canister for delivery of fluid to a location of use; and a transfer vessel in fluid communication with the at least one bulk canister via a first fluid line and the process canister via a second fluid line, the transfer vessel adapted to supply the process canister with fluid from the at least one bulk canister, wherein the transfer vessel has a volumetric capacity that is less than the volumetric capacity of the at least one bulk canister and the process canister and wherein the transfer vessel is coupled with (i) a vacuum source including a first valve for drawing fluid from the at least one bulk canister through the first fluid line into the transfer vessel (103) and selectively maintaining a vacuum condition in the at least one bulk canister through activation of the first valve, and (ii) a first source of pressurizing gas for pressure-mediated transfer of fluid from the transfer vessel into said process canister via the second fluid line through activation of a second valve, wherein the transfer vessel is adapted to be cycled between a vacuum state and a pressure state.

2. The system of claim 1, wherein the process canister is coupled with a second source of pressurizing gas for pressure-mediated delivery of fluid to the location of use.

3. The system of claim 2, wherein the first source of pressurizing gas creates greater pressure than the second source of pressurizing gas.

4. The system of claim 1, wherein the at least one bulk canister is coupled with a third source of pressurizing gas arranged to selectively counter-balance the vacuum condition.

5. The system of claim 1, wherein the at least one bulk canister comprises any one of a stainless steel vessel, a plastic vessel, a glass bottle, or a collapsible bag.

6. The system of claim 1, further comprising at least one pressure transducer adapted to sense pressure of fluid in the at least one bulk canister and produce a transducer output indicative of the said pressure, and a processor adapted to receive said transducer output and responsively determine rate of change of pressure of said fluid and provide a processor output indicative of an increased rate of change correlative to onset of exhaustion of fluid in the at least one bulk canister, when the at least one bulk canister is at onset of exhaustion of fluid.

7. The system of claim 1, wherein fluid holding volume of the transfer vessel is less than fluid holding volume of any one of the at least one bulk canister and the process canister.

8. The system of claim 1, wherein the location of use comprises a semiconductor manufacturing tool.

9. The system of claim 1, wherein at least one of the at least one bulk canister, transfer vessel and process canister is of non-stainless steel construction.

10. The system of claim 9, wherein the at least one bulk canister is of non-stainless steel construction.

11. A method of delivering fluid for use thereof, the method characterized by:

drawing fluid under vacuum from at least one bulk canister into a transfer vessel;

pressurizing the transfer vessel to dispense the fluid to a process container; and selectively maintaining a vacuum condition in the at least one bulk canister.

* * * * *